US005390737A

United States Patent [19]

Jacobi et al.

[11] Patent Number: 5,390,737

[45] Date of Patent: Feb. 21, 1995

[54] DOWNHOLE TOOL WITH SLIDING VALVE

[75] Inventors: Ricky D. Jacobi; Kevin T. Berscheidt; Donald F. Hushbeck, all of Duncan, Okla.

[73] Assignee: Halliburton Company, Duncan, Okla.

[21] Appl. No.: 99,690

[22] Filed: Jul. 29, 1993

Related U.S. Application Data

[63] Continuation-in-part of Ser. No. 719,740, Jun. 21, 1991, Pat. No. 5,271,468, which is a continuation-in-part of Ser. No. 515,019, Apr. 26, 1990, abandoned.

[51] Int. Cl.[6] ..... E21B 23/00; E21B 33/128; E21B 33/129; E21B 34/14

[52] U.S. Cl. ..... 166/184; 166/131; 166/185; 166/242; 166/134; 166/142; 166/387

[58] Field of Search ..... 166/131, 184, 123, 185, 166/186

[56] References Cited

U.S. PATENT DOCUMENTS

| | | | |
|---|---|---|---|
| 1,648,377 | 11/1927 | Crowell . | |
| 2,043,225 | 6/1936 | Armentrout et al. . | |
| 2,084,611 | 6/1937 | Crickmer | 166/131 |
| 2,155,129 | 4/1939 | Hall et al. . | |
| 2,205,119 | 6/1940 | Hall et al. . | |
| 2,331,185 | 10/1943 | Gordy | 166/131 X |
| 2,589,506 | 3/1952 | Morrisett . | |
| 2,695,672 | 11/1954 | Lane | 166/131 |
| 2,753,940 | 7/1956 | Bonner | 166/184 X |
| 2,778,430 | 1/1957 | Baker | 166/139 |
| 2,806,536 | 9/1957 | Baker et al. | 166/123 |
| 3,055,424 | 9/1962 | Allen | 166/242 X |
| 3,529,667 | 9/1970 | Malone . | |
| 3,643,282 | 2/1972 | Lechene et al. | 15/179 |
| 3,710,862 | 1/1973 | Young et al. | 166/278 |
| 3,910,348 | 10/1975 | Pitts | 166/134 |
| 4,067,358 | 1/1978 | Streich | 137/624.13 |
| 4,151,875 | 5/1979 | Sullaway | 166/126 |
| 4,300,631 | 11/1981 | Sainato et al. | 166/187 |
| 4,520,870 | 6/1985 | Pringle | 166/317 |
| 4,708,202 | 11/1987 | Sukup et al. | 166/123 |
| 4,784,226 | 11/1988 | Wyatt | 166/376 |
| 4,834,176 | 5/1989 | Renfroe, Jr. | 166/142 |
| 4,834,184 | 5/1989 | Streich et al. | 166/376 |
| 4,858,687 | 8/1989 | Watson et al. | 166/153 |
| 4,915,175 | 4/1990 | Mashaw, Jr. | 166/332 |
| 4,977,958 | 12/1990 | Miller | 166/205 |

OTHER PUBLICATIONS

Halliburton Sales & Service Catalog No. 43, published in 1985, pp. 2561–2562; 2556–2557; 2427–2434.

Halliburton Services Sales Technical Paper S-8107 entitled "Successful Drill Out of Shoe Joints with PDC Bits," published in Mar., 1989.

Chapter 4, *Fundamentals of Drilling*, by John L. Kennedy, PennWell Books, Copyright 1983.

"Molding Compounds Materials Selection Handbook," published by Fiberite Corporation, Copyright, 1986.

*Primary Examiner*—Stephen J. Novosad

*Attorney, Agent, or Firm*—Stephen R. Christian; Neal R. Kennedy

[57] ABSTRACT

A downhole tool apparatus and methods of drilling the apparatus. The apparatus may include, but is not limited to, packers and bridge plugs utilizing non-metallic components. The non-metallic components may include but are not limited to the center mandrel having an unmachined, molded central opening therethrough. In a preferred embodiment, a sliding valve is disposed on an outer surface of the center mandrel for opening and closing a valve port. An overshot is used to selectively actuate the sliding valve. Methods of installation and drilling out of the apparatus are also disclosed.

20 Claims, 6 Drawing Sheets

DOWNHOLE TOOL WITH SLIDING VALVE

This application is a continuation-in-part of application Ser. No. 07/719,740, filed Jun. 21, 1991, now U.S. Pat. No. 5,271,468, which was a continuation-in-part of application Ser. No. 07/515,019, filed Apr. 26, 1990, now abandoned.

BACKGROUND OF THE INVENTION

1. Field of the Invention

The invention relates to downhole tools for use in wellbores, and more particularly, to such tools having a sliding valve for controlling fluid flow therethrough at the upper end thereof. These tools, such as packers, may have drillable components, such as the valve, therein made at least partially of non-metallic materials, such as engineering grade plastics.

2. Description of the Prior Art

In the drilling or reworking of oil wells, a great variety of downhole tools are used. For example, but not by way of limitation, it is often desirable to seal tubing or other pipe in the casing of the well, such as when it is desired to pump cement or other slurry down tubing and force the slurry out into a formation. It then becomes necessary to seal the tubing with respect to the well casing and to prevent the fluid pressure of the slurry from lifting the tubing out of the well. Packers designed for these general purposes are well known in the art, and valves for controlling fluid flow through the packers once the packers are set are also known.

When it is desired to remove many of these downhole tools from a well bore, it is frequently simpler and less expensive to mill or drill them out rather than to implement a complex retrieving operation. In milling, a milling cutter is used to grind the tool, or at least the outer components thereof, out of the well bore. Milling is a relatively slow process, but it can be used on tools having relatively hard components such as erosion-resistant hard steel. One such tool is the packer disclosed in U.S. Pat. No. 4,151,875 to Sullaway, assigned to the assignee of the present invention and sold under the trademark EZ Disposal packer.

In drilling, a drill bit is used to cut and grind up the components of the downhole tool to remove it from the well bore. This is a much faster operation than milling, but requires the tool to be made out of materials which can be accommodated by the drill bit. Typically, soft and medium hardness cast iron are used on the pressure bearing components, along with some brass and aluminum items. Tools of this type include the Halliburton EZ Drill® and EZ Drill SV® squeeze packers.

The EZ Drill SV® squeeze packer, for example, includes a lock ring housing, upper slip wedge, lower slip wedge, and lower slip support made of soft cast iron. These components are mounted on a mandrel made of medium hardness cast iron. The EZ Drill® squeeze packer is similarly constructed. The Halliburton EZ Drill® bridge plug is also similar, except that it does not provide for fluid flow therethrough.

Such drillable devices have worked well and provide improved operating performance at relatively high temperatures and pressures. Tools such as the packers and plug mentioned above are designed to withstand pressures of about 10,000 psi and temperatures of about 425° F. after being set in the well bore. Such pressures and temperatures require the cast iron components previously discussed.

However, drilling out iron components requires certain techniques. Ideally, the operator employs variations in rotary speed and bit weight to help break up the metal parts and reestablish bit penetration should bit penetration cease while drilling. A phenomenon known as "bit tracking" can occur, wherein the drill bit stays on one path and no longer cuts into the downhole tool. When this happens, it is necessary to pick up the bit above the drilling surface and rapidly recontact the bit with the packer or plug and apply weight while continuing rotation. This aids in breaking up the established bit pattern and helps to reestablish bit penetration. If this procedure is used, there are rarely problems. However, operators may not apply these techniques or even recognize when bit tracking has occurred. The result is that drilling times are greatly increased because the bit merely wears against the surface of the downhole tool rather than cutting into it to break it up.

While cast iron components may be necessary for the high pressures and temperatures for which they are designed, it has been determined that many wells experience pressures less than 10,000 psi and temperatures less than 425° F. This includes most wells cemented. In fact, in the majority of wells, the pressure is less than about 5,000 psi, and the temperature is less than about 250° F. Thus, the heavy duty metal construction of the previous downhole tools, such as the packers and bridge plugs described above, is not necessary for many applications, and if cast iron components can be eliminated or minimized, the potential drilling problems resulting from bit tracking might be avoided as well.

Some embodiments of the downhole tool of the present invention solve this problem by providing an apparatus wherein at least some of the components, including pressure bearing components, are made of non-metallic materials, such as engineering grade plastics. Such plastic components are much more easily drilled than cast iron, and new drilling methods may be employed which use alternative drill bits such as polycrystalline diamond compact bits, or the like, rather than standard tri-cone bits.

The Halliburton EZ Drill SV® squeeze packer has a pressure balance sliding valve for control of fluid movement in the well. The valve is disposed in a center mandrel of the packer. The valve is operated by reciprocation of the tubing, and may be opened and closed, as desired, before and after squeeze cementing. Some of the embodiments of the present invention also utilize a sliding valve within the mandrel, but differ in the use of non-metallic components.

Although the EZ Drill SV® configuration with the valve disposed in the mandrel has worked well, it does require machine work on the inside of the mandrel. This would also be true on the non-metallic embodiments disclosed herein. Of course, any machining adds to the cost of the components. Also, the valve itself which slides inside the mandrel reduces the flow area through the packer, thus causing at least some restriction to the inside of the packer mandrel. Thus, there is a need for a downhole tool, such as a packer, with less flow restriction therethrough and one in which the inner surface of the mandrel requires no machining. Further, in order to operate a packer of the EZ Drill SV® configuration, it is necessary to run a stinger into the tool to actuate the valve. In some wells, proper insertion of the stinger may be difficult, and therefore elimination of the need for a stinger is desirable in these cases.

A preferred embodiment of the present invention solves these problems by utilizing a valve disposed on the outside of the mandrel so that there is no need for machining the inside surface of the mandrel. Because the valve is on the outside of the mandrel, there is no necessity for a stinger. Rather, a simpler-to-operate overshot is used to actuate the valve. This particular embodiment of the invention may be utilized for downhole tools with metallic components as well as non-metallic components. The elimination of machining in the mandrel is particularly important in tools wherein the mandrels are made of non-metallic materials, because the mandrel may be fabricated by molding the inside diameter to size. Such a molding process would create a sufficiently smooth finished internal diameter when there is no sliding valve disposed therein.

Another problem with packers having the valve below the packer element is that this results in pressure being held at the bottom of the packer. When drilling out the packer, the upper slips which keep the packer from moving upwardly are drilled first and released from engagement with the well bore before the pressure is relieved therebelow. This can result in the packer being forced upwardly by pressure acting thereon which can cause jamming of the drill bit or can cause the entire tool string to move up the well bore. To avoid this, it is necessary to open the valve before the drilling process which may not always be desirable.

The preferred embodiment using the valve on the outside of the mandrel also preferably positions the valve above the packer elements. In this way, as the packer is drilled out, the valve is drilled before the slips and packer elements. Thus, pressure is relieved while the packer is still held in the well bore by the slips. Thus, no pressure surge can result in a portion of the tool being forced upwardly.

SUMMARY OF THE INVENTION

In certain embodiments, the downhole tool apparatus of the present invention preferably utilizes non-metallic materials, such as engineering grade plastics, to reduce weight, to reduce manufacturing time and labor, to improve performance through reducing frictional forces of sliding surfaces, to reduce costs and to improve drillability of the apparatus when drilling is required to remove the apparatus from the well bore. Primarily, in this disclosure, the downhole tool is characterized by well bore packing apparatus, but it is not intended that the invention be limited to such packing devices. The non-metallic components in the downhole tool apparatus also allow the use of alternative drilling techniques to those previously known.

In packing apparatus embodiments of the present invention, the apparatus may utilize the same general geometric configuration of previously known drillable packers and bridge plugs while replacing at least some of the metal components with non-metallic materials which can still withstand the pressures and temperatures exposed thereto in many well bore applications. In other embodiments of the present invention, the apparatus may comprise specific design changes to accommodate the advantages of plastic materials and also to allow for the reduced strengths thereof compared to metal components.

In one embodiment of the downhole tool, the invention comprises a center mandrel and slip means disposed on the mandrel for grippingly engaging the well bore when in a set position. In packing embodiments, the apparatus further comprises a packing means disposed on the mandrel for sealingly engaging the well bore when in a set position.

The slip means may comprise a wedge engaging a plurality of slips with a slip support on the opposite side of the slips from the wedge. Any of the mandrel, slips, slip wedges or slip supports may be made of the non-metallic material, such as plastic. Specific plastics include nylon, phenolic materials and epoxy resins. The phenolic materials may further include any of Fiberite FM4056J, Fiberite FM4005 or Resinoid 1360. The plastic components may be molded or machined.

In one preferred embodiment, the center mandrel is molded of a non-metallic material with the internal surface thereof molded to size. That is, there is no machining on the inside diameter of the center mandrel in this embodiment.

One preferred plastic material for at least some of these components is a glass reinforced phenolic resin having a tensile strength of about 18,000 psi and a compressive strength of about 40,000 psi, although the invention is not intended to be limited to this particular plastic or a plastic having these specific physical properties. The plastic materials are preferably selected such that the packing apparatus can withstand well pressures less than about 10,000 psi and temperatures less than about 425° F. In one preferred embodiment, but not by way of limitation, the plastic materials of the packing apparatus are selected such that the apparatus can withstand well pressures up to about 5,000 psi and temperatures up to about 250° F.

Most of the components of the slip means are subjected to substantially compressive loading when in a sealed operating position in the well bore, although some tensile loading may also be experienced. The center mandrel typically has tensile loading applied thereto when setting the packer and when the packer is in its operating position.

In a preferred embodiment of the invention, a sliding valve is disposed on the outside of the center mandrel to control flow through the packer. This particular embodiment is intended for use on tools of metallic or non-metallic construction. However, it is particularly well adapted to a packer of non-metallic construction because it allows the use of a molded center mandrel without machining on the inside thereof, as previously described.

Numerous objects and advantages of the invention will become apparent as the following detailed description of the preferred embodiments is read in conjunction with the drawings which illustrate such preferred embodiments.

DESCRIPTION OF THE PREFERRED EMBODIMENT

Figure 1:
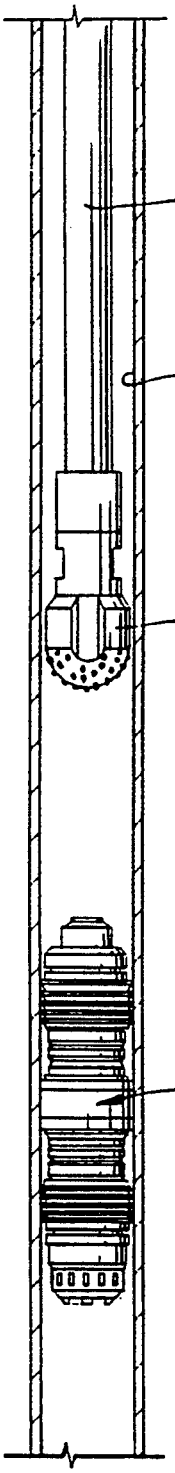
FIG. 1 generally illustrates the downhole tool of the present invention positioned in a well bore with a drill bit disposed thereabove.

Referring now to the drawings, and more particularly to FIG. 1, the downhole tool apparatus of the present invention is shown and generally designated by the numeral 10. Apparatus 10, which may include, but is not limited to, packers, bridge plugs, or similar devices, is shown in an operating position in a well bore 12. Apparatus 10 can be set in this position by any manner known in the art such as setting on a tubing string or wire line. A drill bit 14 connected to the end of a tool or tubing string 16 is shown above apparatus 10 in a position to commence the drilling out of apparatus 10 from well bore 12. Methods of drilling will be further discussed herein.

First Embodiment

Figure 2:
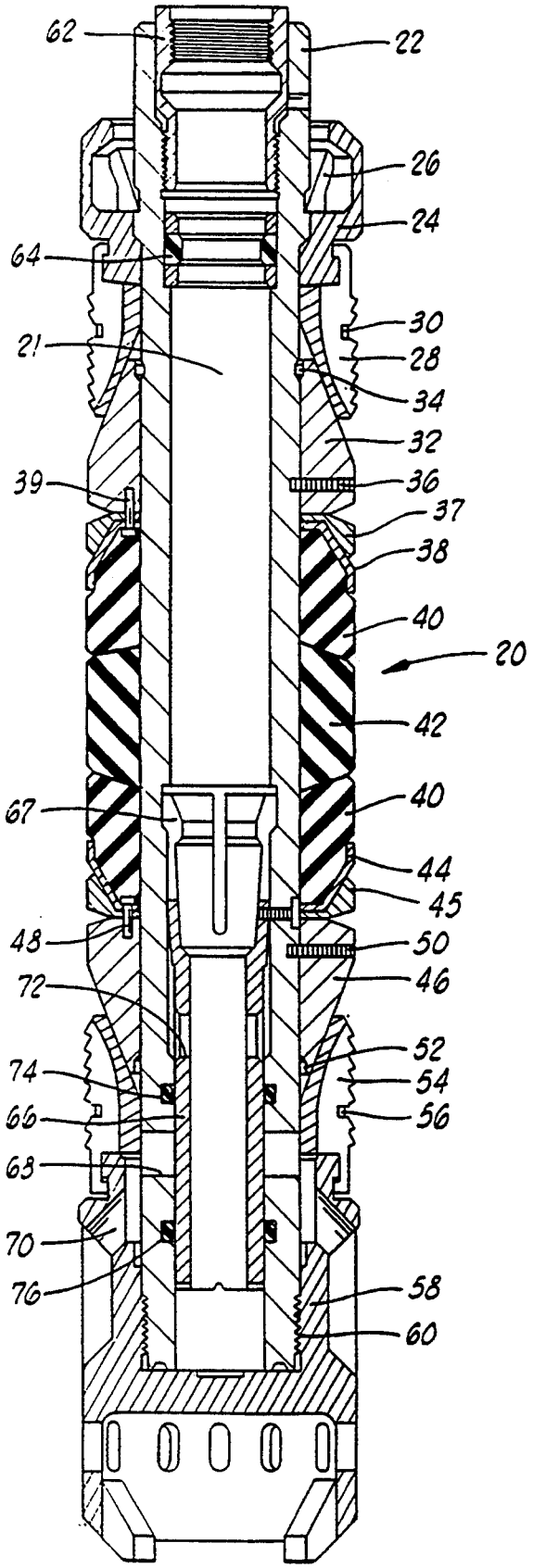
FIG. 2 illustrates a cross section of one embodiment of a drillable packer made in accordance with the invention.

Referring now to FIG. 2, the details of a first squeeze packer embodiment 20 of apparatus 10 will be described. The size and configuration of packer 20 is substantially the same as the previously mentioned prior art EZ Drill SV® squeeze packer. Packer 20 defines a generally central opening 21 therein.

Packer 20 comprises a center mandrel 22 on which most of the other components are mounted. A lock ring housing 24 is disposed around an upper end of mandrel 22 and generally encloses a lock ring 26.

Disposed below lock ring housing 24 and pivotally connected thereto are a plurality of upper slips 28 initially held in place by a retaining band 30. A generally conical upper slip wedge is disposed around mandrel 22 adjacent to upper slips 30. Upper slip wedge 32 is held in place on mandrel 22 by a wedge retaining ring 34 and a plurality of screws 36.

Adjacent to the lower end of upper slip wedge 32 is an upper back-up ring 37 and an upper packer shoe 38 connected to the upper slip wedge by a pin 39. Below upper packer shoe 38 are a pair of end packer elements 40 separated by center packer element 42. A lower packer shoe 44 and lower back-up ring 45 are disposed adjacent to the lowermost end packer element 40.

A generally conical lower slip wedge 46 is positioned around mandrel 22 adjacent to lower packer shoe 44, and a pin 48 connects the lower packer shoe to the lower slip wedge.

Lower slip wedge 46 is initially attached to mandrel 22 by a plurality of screws 50 and a wedge retaining ring 52 in a manner similar to that for upper slip wedge 32. A plurality of lower slips 54 are disposed adjacent to lower slip wedge 46 and are initially held in place by a retaining band 56. Lower slips 54 are pivotally connected to the upper end of a lower slip support 58. Mandrel 22 is attached to lower slip support 58 at threaded connection 60.

Disposed in mandrel 22 at the upper end thereof is a tension sleeve 62 below which is an internal seal 64. Tension sleeve 62 is adapted for connection with a setting tool (not shown) of a kind known in the art.

A collet-latch sliding valve 66 is slidably disposed in central opening 21 at the lower end of mandrel 22 adjacent to fluid ports 68 in the mandrel. Fluid ports 68 in mandrel 22 are in communication with fluid ports 70 in lower slip housing 58. The lower end of lower slip support 58 is closed below ports 70.

Sliding valve 66 defines a plurality of valve ports 72 which can be aligned with fluid ports 68 in mandrel 22 when sliding valve 66 is in an open position. Thus, fluid can flow through central opening 21.

On the upper end of sliding valve 66 are a plurality of collet fingers 67 which are adapted for latching and unlatching with a valve actuation tool (not shown) of a kind known in the art. This actuation tool is used to open and close sliding valve 66 as further discussed herein. As illustrated in FIG. 2, sliding valve 66 is in a closed position wherein fluid ports 68 are sealed by upper and lower valve seals 74 and 76.

In prior art drillable packers and bridge plugs of this type, mandrel 22 is made of a medium hardness cast iron, and lock ring housing 24, upper slip wedge 32, lower slip wedge 46 and lower slip support 58 are made of soft cast iron for drillability. Most of the other components are made of aluminum, brass or rubber which, of course, are relatively easy to drill. Prior art upper and lower slips 28 and 54 are made of hard cast iron, but are grooved so that they will easily be broken up in small pieces when contacted by the drill bit during a drilling operation.

As previously described, the soft cast iron construction of prior art lock ring housings, upper and lower slip wedges, and lower slip supports are adapted for relatively high pressure and temperature conditions, while a majority of well applications do not require a design for such conditions. Thus, the apparatus of the present invention, which is generally designed for pressures lower than 10,000 psi and temperatures lower than 425° F., utilizes engineering grade plastics for at least some of the components. For example, the apparatus may be designed for pressures up to about 5,000 psi and temperatures up to about 250° F., although the invention is not intended to be limited to these particular conditions.

In first packer embodiment 20, at least some of the previously soft cast iron components of the slip means, such as lock ring housing 24, upper and lower slip wedges 32 and 46 and lower slip support 58 are made of engineering grade plastics. In particular, upper and lower slip wedges 32 and 46 are subjected to substantially compressive loading. Since engineering grade plastics exhibit good strength in compression, they make excellent choices for use in components subjected to compressive loading. Lower slip support 58 is also subjected to substantially compressive loading and can be made of engineering grade plastic when packer 20 is subjected to relative low pressures and temperatures.

Lock ring housing 24 is mostly in compression, but does exhibit some tensile loading. However, in most situations, this tensile loading is minimal, and lock ring housing 24 may also be made of an engineering grade plastic of substantially the same type as upper and lower slip wedges 32 and 46 and also lower slip housing 58.

Upper and lower slips 28 and 54 may also be of plastic in some applications. Hardened inserts for gripping well bore 12 when packer 20 is set may be required as part of the plastic slips. Such construction is discussed in more detail herein for other embodiments of the invention.

Lock ring housing 24, upper slip wedge 32, lower slip wedge 46, and lower slip housing 58 comprise approximately 75% of the cast iron of the prior art squeeze packers. Thus, replacing these components with similar components made of engineering grade plastics will enhance the drillability of packer 20 and reduce the time and cost required therefor.

Mandrel 22 is subjected to tensile loading during setting and operation, and many plastics will not be acceptable materials therefor. However, some engineering plastics exhibit good tensile loading characteristics, so that construction of mandrel 22 from such plastics is possible. Reinforcements may be provided in the plastic resin as necessary.

Second Embodiment

Figure 3A:
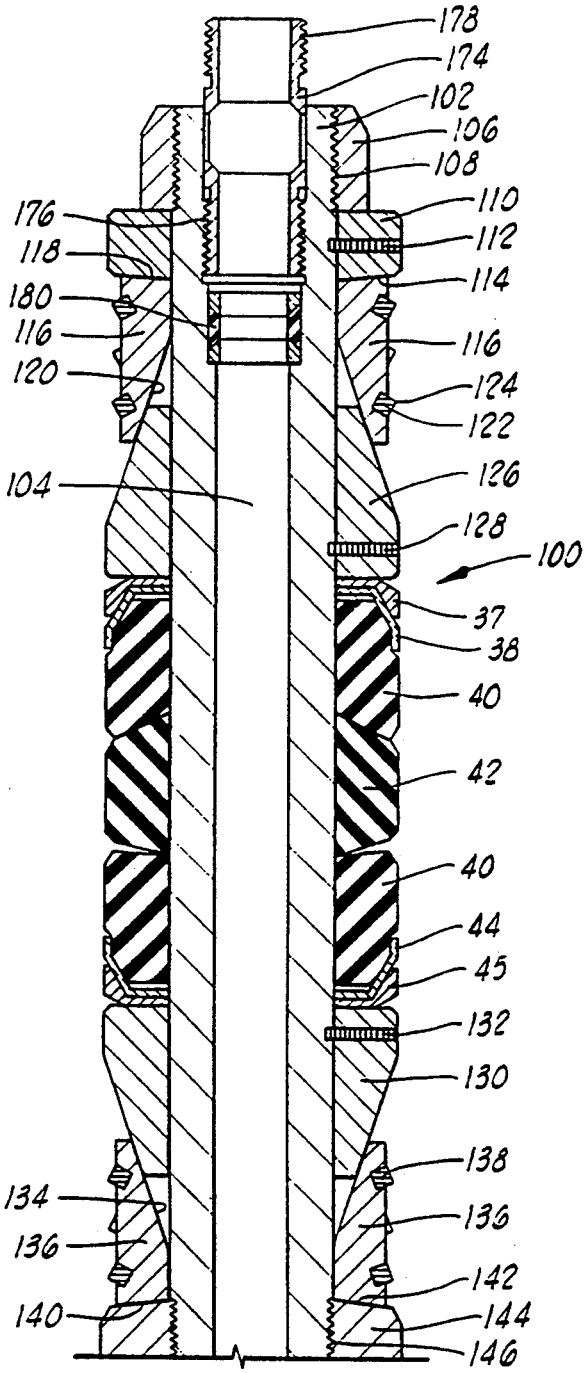
FIGS. 3A and 3B show a cross section of a second embodiment of a drillable packer.
Figure 3B:
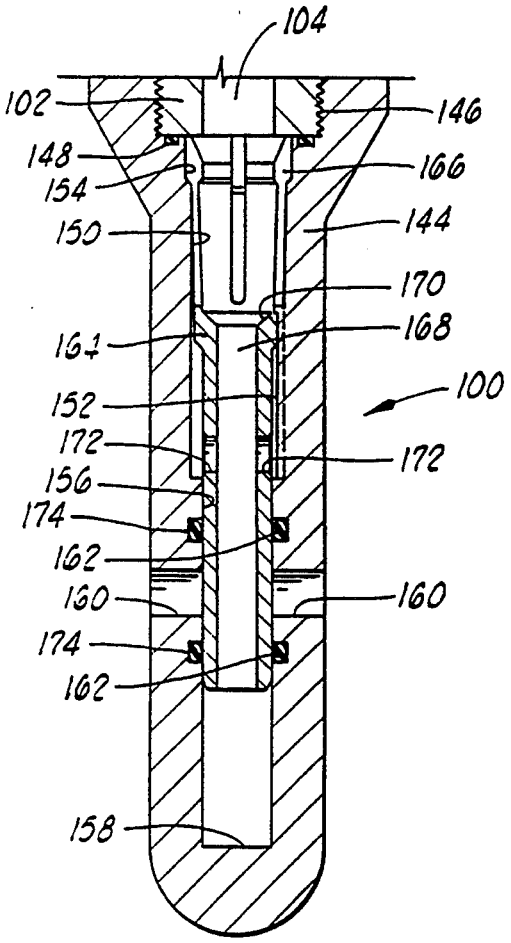

Referring now to FIGS. 3A and 3B, the details of a second squeeze packer embodiment 100 of packing apparatus 10 are shown. While first embodiment 20 incorporates the same configuration and general components as prior art packers made of metal, second packer embodiment 100 and the other embodiments described herein comprise specific design features to accommodate the benefits and problems of using nonmetallic components, such as plastic.

Packer 100 comprises a center mandrel 102 on which most of the other components are mounted. Mandrel 102 may be described as a thick cross-sectional mandrel having a relatively thicker wall thickness than typical packer mandrels, including center mandrel 22 of first embodiment 20. A thick cross-sectional mandrel may be generally defined as one in which the central opening therethrough has a diameter less than about half of the outside diameter of the mandrel. That is, mandrel central opening 104 in central mandrel 102 has a diameter less than about half the outside of center mandrel 102. It is contemplated that a thick cross-sectional mandrel will be required if it is constructed from a material having relatively low physical properties. In particular, such materials may include phenolics and similar plastic materials.

An upper support 106 is attached to the upper end of center mandrel 102 at threaded connection 108. In an alternate embodiment, center mandrel 102 and upper support 106 are integrally formed and there is no threaded connection 108. A spacer ring or upper slip support 110 is disposed on the outside of mandrel 102 just below upper support 106. Spacer ring 110 is initially attached to center mandrel 102 by at least one shear pin 112. A downwardly and inwardly tapered shoulder 114 is defined on the lower side of spacer ring 110.

Disposed below spacer ring 110 are a plurality of upper slips 116. A downwardly and inwardly sloping shoulder 118 forms the upper end of each slip 116. The taper of each shoulder 118 conforms to the taper of shoulder 114 on spacer ring 110, and slips 116 are adapted for sliding engagement with shoulder 114, as will be further described herein.

An upwardly and inwardly facing taper 120 is defined in the lower end of each slip 116. Each taper 120 generally faces the outside of center mandrel 102.

A plurality of hardened inserts or teeth 122 preferably are molded into upper slips 116. In the embodiment shown in FIG. 3A, inserts 122 have a generally square cross section and are positioned at an angle so that a radially outer edge 124 protrudes from the corresponding upper slip 116. Outer edge 124 is adapted for grippingly engaging well bore 12 when packer 100 is set. It is not intended that inserts 122 be of square cross section and have a distinct outer edge 124. Different shapes of inserts may also be used. Inserts 122 can be made of any suitable hardened material.

An upper slip wedge 126 is disposed adjacent to upper slips 116 and engages taper 120 therein. Upper slip wedge 126 is initially attached to center mandrel 102 by one or more shear pins 128.

Below upper slip wedge 126 are upper back-up ring 37, upper packer shoe 38, end packer elements 40 separated by center packer element 42, lower packer shoe 44 and lower back-up ring 45 which are substantially the same as the corresponding components in first embodiment packer 20. Accordingly, the same reference numerals are used.

Below lower back-up ring 45 is a lower slip wedge 130 which is initially attached to center mandrel 102 by a shear pin 132. Preferably, lower slip wedge 130 is identical to upper slip wedge 126 except that it is positioned in the opposite direction.

Lower slip wedge 130 is in engagement with an inner taper 134 in a plurality of lower slips 136. Lower slips 136 have inserts or teeth 138 molded therein, and preferably, lower slips 136 are substantially identical to upper slips 116.

Each lower slip 136 has a downwardly facing shoulder 140 which tapers upwardly and inwardly. Shoulders 140 are adapted for engagement with a corresponding shoulder 142 defining the upper end of a valve housing 144. Shoulder 142 also tapers upwardly and inwardly. Thus, valve housing 144 may also be considered a lower slip support 144.

Referring now also to FIG. 3B, valve housing 146 is attached to the lower end of center mandrel 102 at threaded connection 146. A sealing means, such as O-ring 148, provides sealing engagement between valve housing 144 and center mandrel 102.

Below the lower end of center mandrel 102, valve housing 104 defines a longitudinal opening 150 therein having a longitudinal rib 152 in the lower end thereof. At the upper end of opening 150 is an annular recess 154.

Below opening 150, valve housing 144 defines a housing central opening including a bore 156 therein having a closed lower end 158. A plurality of transverse ports 160 are defined through valve housing 144 and intersect bore 156. The wall thickness of valve housing 144 is thick enough to accommodate a pair of annular seal grooves 162 defined in bore 156 on opposite sides of ports 160.

Slidably disposed in valve housing 144 below center mandrel 102 is a sliding valve 164. Sliding valve 164 is the same as, or substantially similar to, sliding valve 66 in first embodiment packer 20. At the upper end of sliding valve 164 are a plurality of upwardly extending collet fingers 166 which initially engage recess 154 in valve housing 144. Sliding valve 164 is shown in an uppermost, closed position in FIG. 3B. It will be seen that the lower end of center mandrel 102 prevents further upward movement of sliding valve 164.

Sliding valve 164 defines a valve central opening 168 therethrough which is in communication with central opening 104 in center mandrel 102. A chamfered shoulder 170 is located at the upper end of valve central opening 168.

Sliding valve 164 defines a plurality of substantially transverse ports 172 therethrough which intersect valve central opening 168. As will be further discussed herein, ports 172 are adapted for alignment with ports 160 in valve housing 144 when sliding valve 164 is in a downward, open position thereof. Rib 152 fits between a pair of collet fingers 166 so that sliding valve 164 cannot rotate within valve housing 144, thus insuring proper alignment of ports 172 and 160. Rib 152 thus provides an alignment means.

A sealing means, such as O-ring 173, is disposed in each seal groove 162 and provides sealing engagement between sliding valve 164 and valve housing 144. It will thus be seen that when sliding valve 164 is moved downwardly to its open position, O-rings 173 seal on opposite sides of ports 172 in the sliding valve.

Referring again to FIG. 3A, a tension sleeve 174 is disposed in center mandrel 102 and attached thereto to threaded connection 176. Tension sleeve 174 has a threaded portion 178 which extends from center mandrel 102 and is adapted for connection to a standard setting tool (not shown) of a kind known in the art.

Below tension sleeve 174 is an internal seal 180 similar to internal seal 64 in first embodiment 20.

Third Embodiment

Figure 4A:
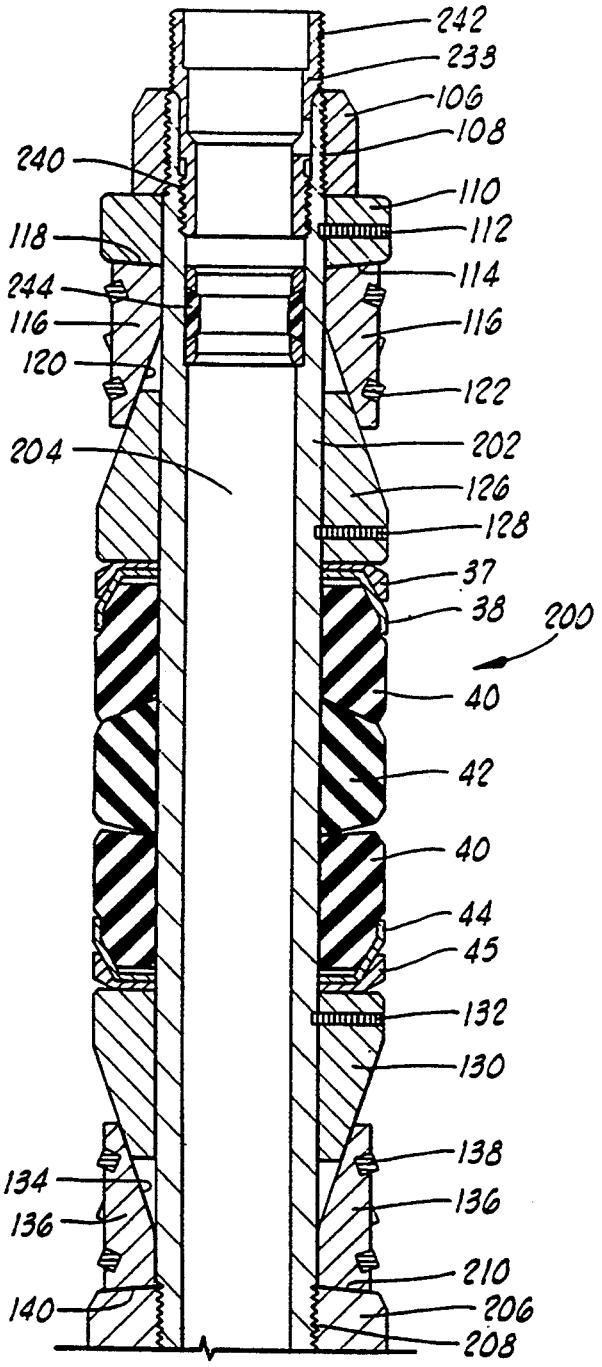
FIGS. 4A and 4B show a third drillable packer embodiment.
Figure 4B:
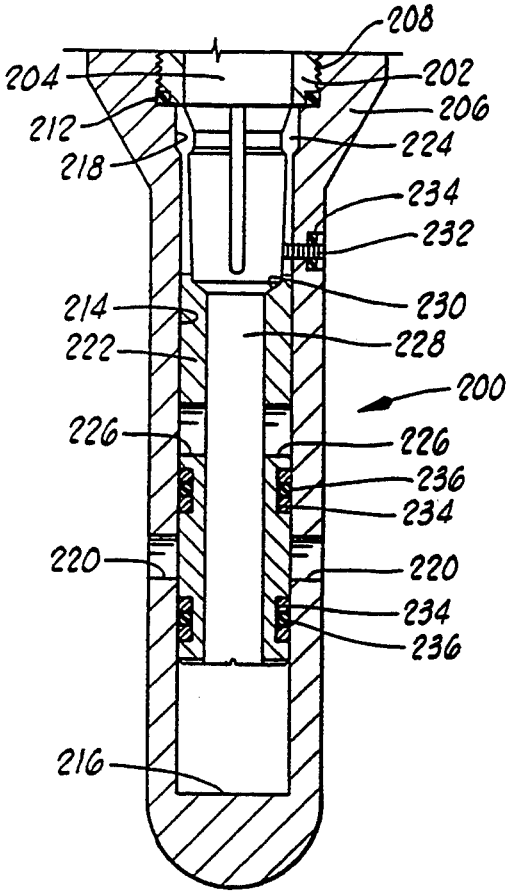

Referring now to FIGS. 4A and 4B, a third squeeze packer embodiment of the present invention is shown and generally designated by the numeral 200. It will be clear to those skilled in the art that third embodiment 200 is similar to second packer embodiment 100 but has a couple of significant differences.

Packer 200 comprises a center mandrel 202. Unlike center mandrel 102 in second embodiment 100, center mandrel 202 is a thin cross-sectional mandrel. That is, it may be said that center mandrel 102 has a mandrel central opening 204 with a diameter greater than about half of the outside diameter of center mandrel 202. It is contemplated that thin cross-sectional mandrels, such as center mandrel 202, may be made of materials having relatively higher physical properties, such as epoxy resins.

The external components of third packer embodiment 200 which fit on the outside of center mandrel 202 are substantially identical to the outer components on second embodiment 100, and therefore the same reference numerals are shown in FIG. 4A. In a manner similar to second embodiment packer 100, center mandrel 202 and upper support 106 may be integrally formed so that there is no threaded connection 108.

The lower end of center mandrel 202 is attached to a valve housing 206 at threaded connection 208. On the upper end of valve housing 206 is an upwardly and inwardly tapered shoulder 210 against which shoulder 104 on lower slips 136 are slidably disposed. Thus, valve housing 206 may also be referred to as a lower slip support 206.

Referring now also to FIG. 4B, a sealing means, such as O-ring 212, provides sealing engagement between center mandrel 202 and valve housing 206.

Valve housing 206 defines a housing central opening including a bore 214 therein with a closed lower end 216. At the upper end of bore 214 is an annular recess 218. Valve housing 204 defines a plurality of substantially transverse ports 220 therethrough which intersect bore 214.

Slidably disposed in bore 214 in valve housing 206 is a sliding valve 222. At the upper end of sliding valve 222 are a plurality of collet fingers 224 which initially engage recess 218.

Sliding valve 222 defines a plurality of substantially transverse ports 226 therein which intersect a valve central opening 228 in the sliding valve. Valve central opening 228 is in communication with mandrel central opening 204 in center mandrel 202. At the upper end of central opening 228 is a chamfered shoulder 230.

As shown in FIG. 4B, sliding valve 222 is in an uppermost closed position. It will be seen that the lower end of center mandrel 202 prevents further upward movement of sliding valve 222. When sliding valve 222 is moved downwardly to an open position, ports 226 are substantially aligned with ports 220 in valve housing 206. An alignment means, such as an alignment bolt 232, extends from valve housing 206 inwardly between a pair of adjacent collet fingers 224. A sealing means, such as O-ring 234, provides sealing engagement between alignment bolt 232 and valve housing 206. Alignment bolt 234 prevents rotation of sliding valve 222 within valve housing 204 and insures proper alignment of ports 226 and 220 when sliding valve 222 is in its downwardmost, open position.

The wall thickness of sliding valve 222 is sufficient to accommodate a pair of spaced seal grooves 234 are defined in the outer surface of sliding valve 222, and as seen in FIG. 4B, seal grooves 234 are disposed on opposite sides of ports 220 when sliding valve 222 is in the open position shown. A sealing means, such as seal 236, is disposed in each groove 234 to provide sealing engagement between sliding valve 222 and bore 214 in valve housing 206.

Referring again to FIG. 4A, a tension sleeve 238 is attached to the upper end of center mandrel 202 at threaded connection 240. A threaded portion 242 of tension sleeve 238 extends upwardly from center mandrel 202 and is adapted for engagement with a setting apparatus (not shown) of a kind known in the art.

An internal seal 244 is disposed in the upper end of center mandrel 202 below tension sleeve 238.

Fourth Embodiment

Figure 5A:
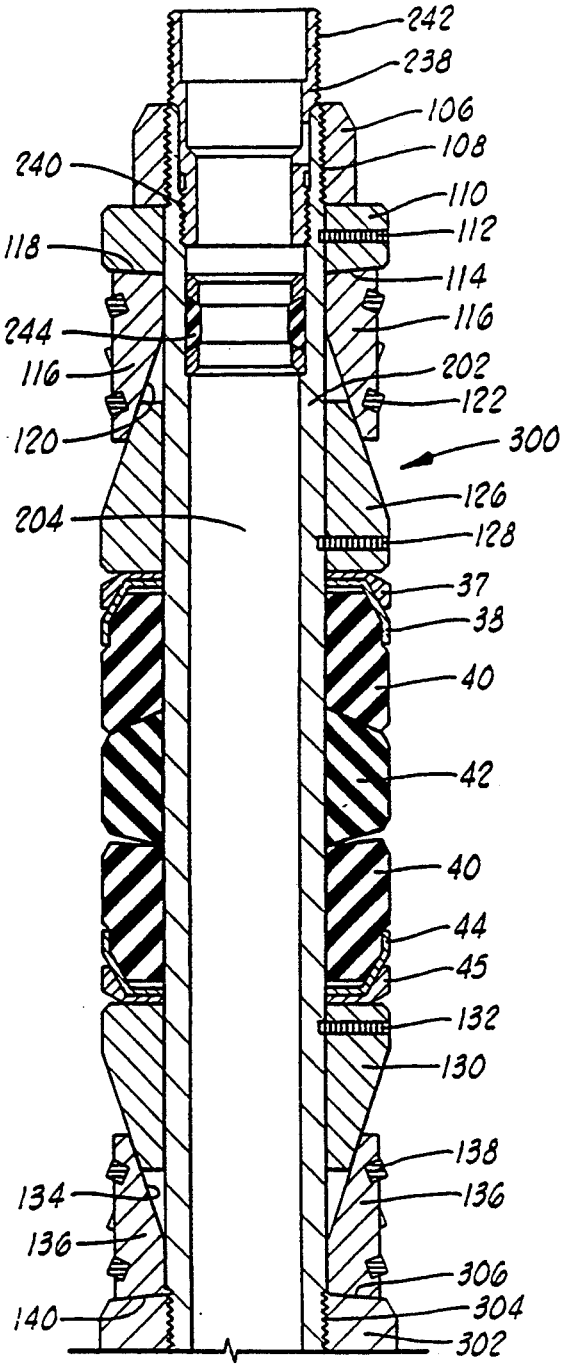
FIGS. 5A and 5B illustrate a fourth embodiment of a drillable packer.
Figure 5B:
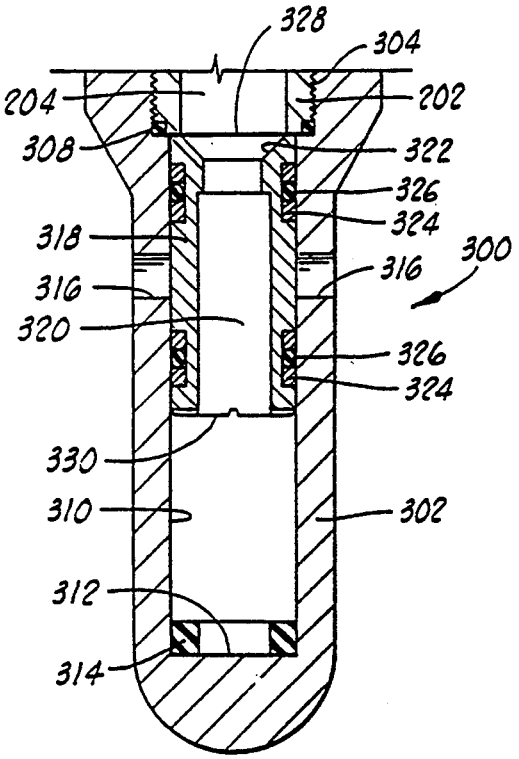

Referring now to FIGS. 5A and 5B, a fourth squeeze packer embodiment is shown and generally designated by the numeral 300. As illustrated, fourth embodiment 300 has the same center mandrel 202, and all of the components positioned on the outside of center mandrel 202 are identical to those in the second and third packer embodiments. Therefore, the same reference numerals are used for these components. Tension sleeve 238 and internal seal 244 positioned on the inside of the upper end of center mandrel 202 are also substantially identical to the corresponding components in third embodiment packer 200 and therefore shown with the same reference numerals.

The difference between fourth packer embodiment 300 and third packer embodiment 200 is that in the fourth embodiment shown in FIGS. 5A and 5B, the lower end of center mandrel 202 is attached to a different valve housing 302 at threaded connection 304. Shoulder 140 on each lower slip 136 slidingly engages an upwardly and inwardly tapered shoulder 306 on the top of valve housing 302. Thus, valve housing 302 may also be referred to as lower slip support 302.

Referring now to FIG. 5B, a sealing means, such as O-ring 308, provides sealing engagement between the lower end of center mandrel 202 and valve housing 302.

Valve housing 302 defines a housing central opening including a bore 310 therein with a closed lower end 312. A bumper seal 314 is disposed adjacent to end 312.

Valve housing 302 defines a plurality of substantially transverse ports 316 therethrough which intersect bore 310. A sliding valve 318 is disposed in bore 310, and is shown in an uppermost, closed position in FIG. 5B. It will be seen that the lower end of center mandrel 202 prevents upward movement of sliding valve 318. Sliding valve 318 defines a valve central opening 320 therethrough which is in communication with mandrel central opening 204 in center mandrel 202. At the upper end of valve central opening 320 in sliding valve 318 is an upwardly facing chamfered shoulder 322.

On the outer surface of sliding valve 318, a pair of spaced seal grooves 324 are defined. In the closed position shown in FIG. 5B, seal grooves 324 are on opposite sides of ports 316 in valve housing 302. A sealing means, such as seal 326, is disposed in each seal groove 324 and provides sealing engagement between sliding valve 318 and bore 310 in valve housing 302.

When sliding valve 318 is opened, as will be further described herein, the sliding valve 318 is moved downwardly such that upper end 328 thereof is below ports 316 in valve housing 302. Downward movement of sliding valve 318 is checked when lower end 330 thereof contacts bumper seal 314. Bumper seal 314 is made of a resilient material which cushions the impact of sliding valve 318 thereon.

Fifth Embodiment with Overshot

Referring now to FIGS. 6A–6D, a preferred fifth embodiment of the present invention is shown and generally designated by the numeral 400. In this embodiment, apparatus 400 comprises a squeeze packer 412, shown in FIGS. 6B–6D, with an overshot 414, shown in FIGS. 6A and 6B, used for actuating the valve, as further described herein. As will be further discussed herein, packer 412 has a sliding valve disposed on the outside of the mandrel thereof, thus eliminating the need for machining in the mandrel. This configuration is well adapted for tools using either metallic or non-metallic materials in the components thereof. Regardless of the materials used in packer 412, there is no need to make overshot 14 of non-metallic materials.

Figure 6A:
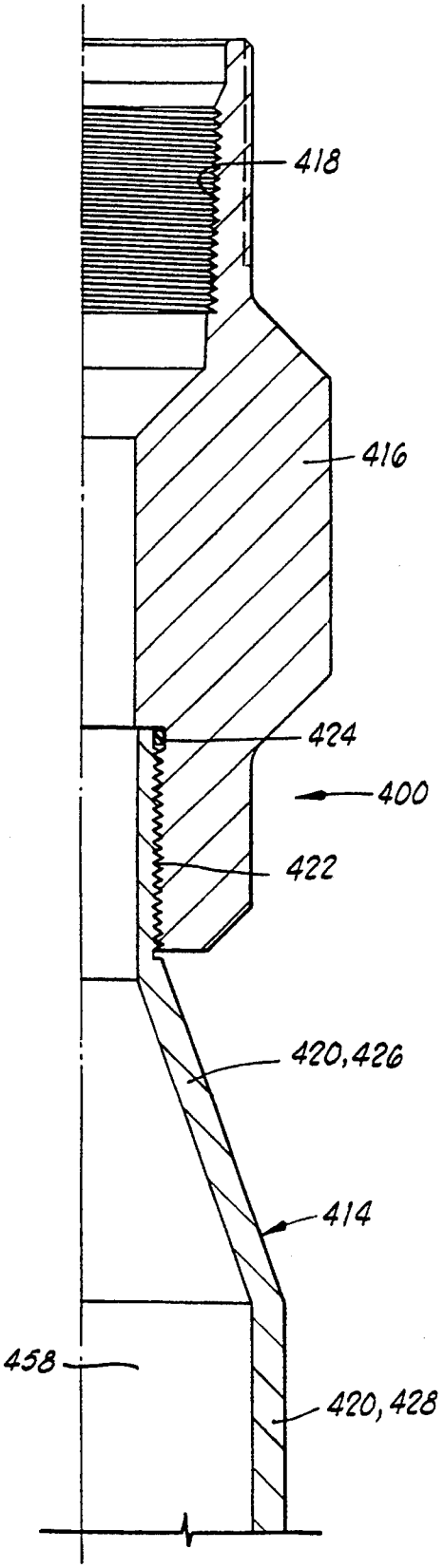
FIGS. 6A-6D show a preferred fifth drillable packer embodiment having a sliding valve on the outside of a center mandrel thereof with an overshot adapted for use in actuating the valve disposed thereabove.

As shown in FIG. 6A, overshot 414 has at its upper end an upper adapter 416 having an internally threaded surface 418 adapted for connection to a tubing string. The lower end of upper adapter 416 is attached to an overshot collar 420 at threaded connection 422. A sealing means, such as O-ring 424, provides sealing engagement between upper adapter 416 and overshot collar 420.

Overshot collar 420 has a tapered or conical portion 426 which extends downwardly and outwardly to a substantially cylindrical portion 428.

Figure 6B:
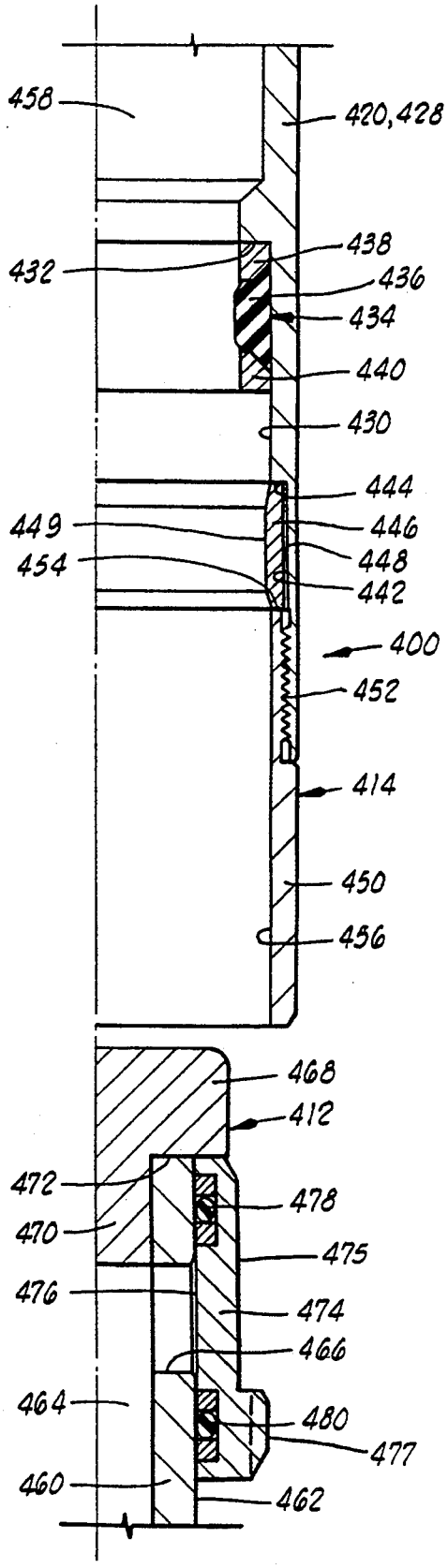

Referring now to FIG. 6B, collar 420 has a first bore 430 therein with an inwardly extending shoulder 432 thereabove. A sealing means 434 is positioned in first bore 430 adjacent to shoulder 432. In the illustrated embodiment, but not by way of limitation, sealing means 434 is characterized by a seal ring 436 which sealingly engages first bore 430 and upper and lower seal backup rings 438 and 440 above and below the seal ring.

Below first bore 430, collar 420 also has a slightly larger second bore 442 therein. A downwardly facing shoulder 444 extends between first bore 430 and second bore 442.

A biasing means, such as a spring ring 446, is disposed in second bore 442 and abuts shoulder 444. The normal outer diameter of spring ring 446 is slightly smaller than second bore 442 such that an annular gap 448 is normally defined therebetween. As will be further discussed herein, spring ring 446 is adapted for gripping engagement with the valve in packer 412.

A collar extension 450 is attached to overshot collar 420 at threaded connection 452. Extension 450 has an upper end 454 which engages spring ring 446 and clamps it against shoulder 444 in overshot collar 420. Thus, longitudinal movement of spring ring 446 is prevented. Collar extension 450 defines a bore 456 therein which has approximately the same diameter as first bore 430 in overshot collar 420. However, it should be understood that it is not necessary that first bore 430 and bore 456 be identical in size.

Figure 6C:
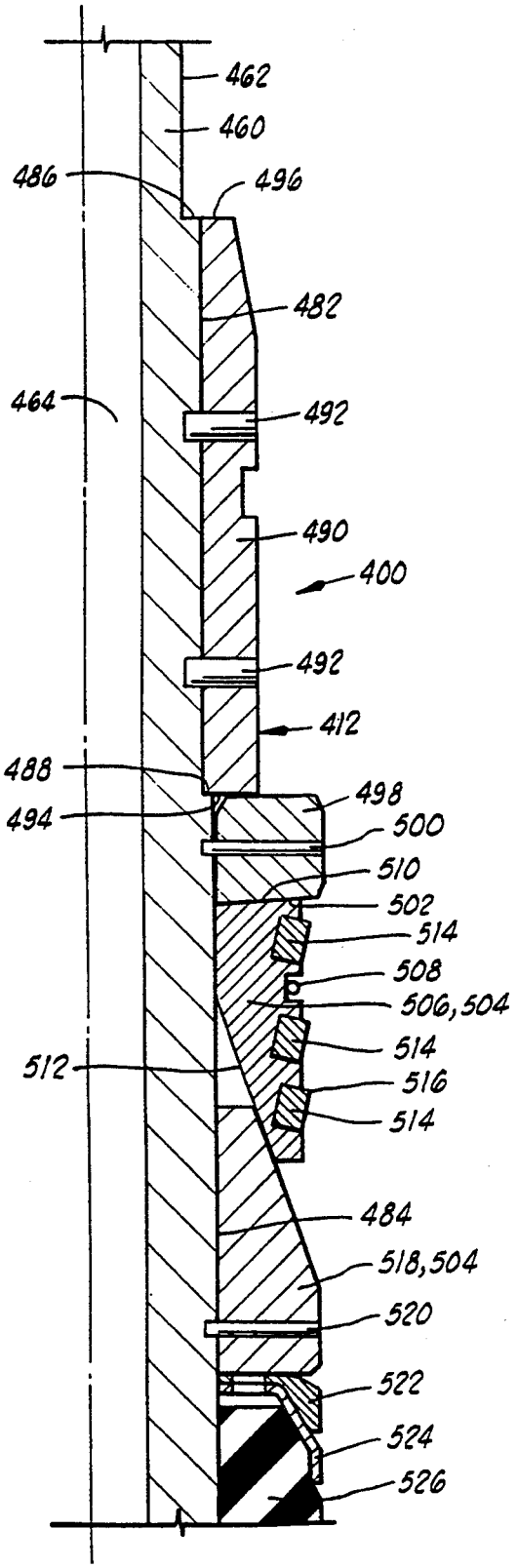
Figure 6D:
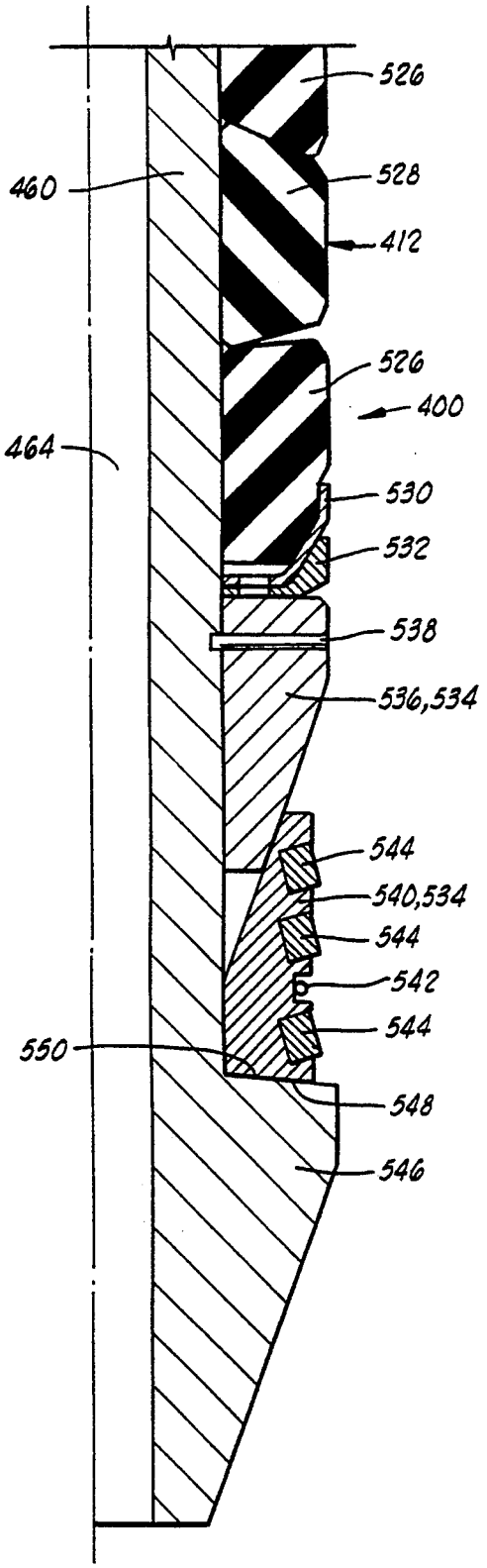

Referring now to FIGS. 6B–6D, the details of packer 412 will be discussed. Packer 412 comprises a center mandrel 460 on which the other components are mounted. In a preferred embodiment, center mandrel 460 is molded or otherwise formed from a non-metallic material, such as an engineering grade plastic. However, it should be understood that fifth embodiment 400 is not intended to be limited to non-metallic materials.

At its upper end, center mandrel 460 has a first outside diameter 462. Center mandrel 460 also defines a central opening 464 therethrough. At least one transversely extending mandrel port 466 is defined in center mandrel 460. Mandrel port 466 provides communication between central opening 464 and first outside diameter 462 of center mandrel 460.

A cap 468 is positioned adjacent to the upper end of central mandrel 460. A lower end 470 of cap 468 extends into central opening 464 of center mandrel 460. In the packer embodiment shown, lower end 470 of cap 468 extends no lower than the upper edge of mandrel port 466. It will be seen by those skilled in the art that packer 412 could be easily converted into a bridge plug by making lower end 470 of cap 468 longer such that it extends below the lower edge of mandrel port 466 and by providing the appropriate sealing between cap 468 and central mandrel 460. In such a bridge plug embodiment, sliding valve 474 described below is, of course, not utilized.

Cap 468 has a downwardly facing shoulder 472 thereon above lower end 470. Shoulder 472 abuts the upper end of center mandrel 460 and extends radially outwardly from first outside diameter 462 of the mandrel. Cap 468 may be attached to mandrel 460 by any means known in the art. For example, but not by way of limitation, for non-metallic materials, cap 468 could be pinned and/or glued or fused by heat to center mandrel 460. Preferably, cap 468 is sealingly engaged with central mandrel 460, regardless of the method of attachment.

As seen in FIG. 6B, a sliding valve 474 is disposed on central mandrel 460 with a bore 476 therein in close, sliding relationship with first outside diameter 462 on the mandrel. Sliding valve 474 has a first outside diameter 475 and a larger second outside diameter 477 thereon.

Upper and lower sealing means, such as upper seal 478 and lower seal 480, provide sliding, sealing engagement between valve 474 and mandrel 460. In the closed position shown in FIG. 6B, upper and lower seals 478 and 480 are on opposite longitudinal sides of mandrel port 466. Also in the closed position, the upper end of valve 474 is adjacent to shoulder 472 of cap 468. It will be seen by those skilled in the art that cap 468 thus limits upward movement of valve 474.

Referring now to FIG. 6C, center mandrel 460 has a second outside diameter 482, larger than first outside diameter 462, and an even larger third outside diameter 484. An upwardly facing shoulder 486 extends between first and second outside diameters 462 and 482, and another upwardly facing shoulder 488 extends between second and third outside diameters 482 and 484.

An upper support 490 is disposed on second outside diameter 482 of center mandrel 460 and is connected thereto by a fastening means known in the art. In FIG. 6C, the fastening means is characterized by pins 492 which extend through upper support 490 and into center mandrel 460.

A lower end 494 of upper support 490 abuts shoulder 488 on central mandrel 460. An upper end 496 of upper support 490 is substantially coplanar with shoulder 486 on center mandrel 460. In other words, the length of upper support 490 is substantially the same as the length of second outside diameter 482 on the center mandrel.

A spacer ring or upper slip support 498 is disposed on third outside diameter 484 of center mandrel 460 just below upper support 490. Upper slip support 498 is initially attached to center mandrel 460 by at least one shear pin 500. A downwardly and inwardly tapered shoulder 502 is defined on the lower side of upper slip support 498.

Disposed below upper slip support 498 is an upper slip means 504 comprising slips in a wedge. In the embodiment shown, upper slip means 504 is characterized as comprising a plurality of separate, non-metallic upper slips 506 held in place by a retaining means, such as retaining band or ring 508 extending at least partially around slips 506. Upper slips 506 may be held in place by other types of retaining means as well, such as pins. Upper slips 506 are preferably circumferentially spaced such that a longitudinally extending gap (not shown) is defined therebetween.

Each slip 506 has a downwardly and inwardly sloping shoulder 510 forming the upper end thereof. The taper of each shoulder 510 conforms to the taper of shoulder 502 on upper slip support 498, and slips 506 are adapted for sliding engagement with shoulder 502, as will be further described herein.

An upwardly and inwardly facing taper 512 is defined in the lower end of each slip 506. Each taper 512 generally faces third outside diameter 484 of center mandrel 460.

A plurality of inserts or teeth 514 are preferably molded into upper slips 504. Inserts 514 are preferably positioned at an angle with respect to a central axis of packer 412. Thus, a radially outer edge 516 of each insert 514 protrudes from upper slip 506. Outer edge 516 is adapted for grippingly engaging a well bore when packer 412 is set. It is not intended that inserts 514 have any particular shape or that they have a distinct outer edge 516. Various shapes of inserts may be used.

Inserts 514 may be made of any suitable hard material. For example, inserts 514 could be hardened steel or a non-metallic hardened material, such as a ceramic.

Upper slip means 504 further comprises an upper slip wedge 518 which is disposed adjacent to upper slips 506 and engages taper 512 therein. Upper slip wedge 518 is initially physically attached to center mandrel 460 on third outside diameter 84 thereof by one or more shear pins 520.

Below upper slip wedge 518 are upper backup ring 522 and upper packer shoe 524. Referring to FIGS. 6C and 6D, below upper packer shoe 524 are a pair of end packer elements 526 separated by a center packer element 528, lower packer shoe 530 and lower backup ring 532.

Below lower backup ring 532 is a lower slip means 534 comprising a lower slip wedge 536 which is initially attached to center mandrel 460 by a shear pin 538. Preferably, lower slip wedge 536 is identical to upper slip wedge 518 except that it is positioned in the opposite direction.

Lower slip means 534 also comprises a plurality of separate, non-metallic lower slips 540. Lower slips 540 are preferably identical to upper slips 506, except for a reversal of position, and are initially held in place by a retaining means, such as retainer band or ring 542 which extends at least partially around slips 540. Other types of retainer means, such as pins, may also be used to hold lower slips 540 in place. Lower slips 540 are preferably circumferentially spaced such that longitudinally extending gaps (not shown) are defined therebetween.

Lower slips 540 have inserts or teeth 544 molded therein which are preferably identical to inserts 514 and upper slips 506.

Below lower slips 540, mandrel 460 has a radially enlarged lower portion 546 which may be described as a lower slip support 546. In the illustrated embodiment, lower slip support 546 is integrally formed as a portion of center mandrel 460. However, in other embodiments, lower slip support 546 could be a separate component affixed to the center mandrel in any manner known in the art.

Each lower slip 540 has a downwardly facing shoulder 548 which tapers upwardly and inwardly. Shoulders 548 are adapted for engagement with a corresponding tapered shoulder 550 on lower slip support 546. That is, shoulder 550 also tapers upwardly and inwardly.

It will be seen by those skilled in the art that for an embodiment of packer 412 made of non-metallic components that upper slip support 498, upper slip means 504, upper backup ring 522, upper packer shoe 524, packer elements 526 and 528, lower packer shoe 530, lower backup ring 532 and lower slip means 534 may be substantially identical to the corresponding components in second packer embodiment 100, third packer embodiment 200 and fourth packer embodiment 300.

SETTING AND OPERATION OF THE APPARATUS

First, Second, Third And Fourth Embodiments

Downhole tool apparatus 10 is positioned in well bore 12 and set into engagement therewith in a manner similar to prior art devices made with metallic components. For example, a prior art apparatus and setting thereof is disclosed in the above-referenced U.S. Pat. No. 4,151,875 to Sullaway. This patent is incorporated herein by reference.

For first packer embodiment 20, the setting tool pulls upwardly on tension sleeve 62, and thereby on mandrel 22, while holding lock ring housing 24. The lock ring housing is thus moved relatively downwardly along mandrel 22 which forces upper slips 28 outwardly and shears screws 36, pushing upper slip wedge 32 downwardly against packer elements 40 and 42. Screws 50 are also sheared and lower slip wedge 46 is pushed downwardly toward lower slip support 58 to force lower slips 54 outwardly. Eventually, upper slips 28 and lower slips 54 are placed in gripping engagement with well bore 12 and packer elements 40 and 42 are in sealing engagement with the well bore. The action of upper slips 28 and 54 prevent packer 20 from being unset. As will be seen by those skilled in the art, pressure below packer 20 cannot force the packer out of well bore 12, but instead, causes it to be even more tightly engaged.

Eventually, in the setting operation, tension sleeve 62 is sheared, so the setting tool may be removed from the well bore.

The setting of second packer embodiment 100, third packer embodiment 200, and fourth packer embodiment 300 is similar to that for first packer embodiment 20. The setting tool is attached to either tension sleeve 174 or 238. During setting, the setting tool pushes downwardly on upper slip support 110, thereby shearing shear pin 112. Upper slips 116 are moved downwardly with respect to upper slip wedge 126. Tapers 120 and upper slips 116 slide along upper slip wedge 126, and shoulders 118 on upper slips 116 slide along shoulder 114 on upper slip support 110. Thus, upper slips 116 are moved radially outwardly with respect to center mandrel 102 or 202 such that edges 124 of inserts 122 grippingly well bore 12.

Also during the setting operation, upper slip wedge 126 is forced downwardly, shearing shear pin 128. This in turn causes packer elements 40 and 42 to be squeezed outwardly into sealing engagement with the well bore.

The lifting on center mandrel 102 or 202 causes the lower slip support (valve housing 144 in first packer embodiment 100, valve housing 206 in second packer embodiment 200 and valve housing 302 in fourth packer embodiment 300) to be moved up and lower slips 136 to be moved upwardly with respect to lower slip wedge 130. Tapers 134 in lower slips 136 slide along lower slip wedge 130, and shoulders 140 on lower slips 136 slide along the corresponding shoulder 142, 210 or 306. Thus, lower slips 136 are moved radially outwardly with respect to center mandrel 102 or 202 so that inserts 138 grippingly engage well bore 12.

Also during the setting operation, lower slip wedge 130 is forced upwardly, shearing shear pin 132, to provide additional squeezing force on packer elements 40 and 42.

The engagement of inserts 122 in upper slips 116 and inserts 138 in lower slips 136 with well bore 12 prevent packers 100, 200 and 300 from coming unset.

Once any of packers 20, 100, 200 or 300 are set, the valves therein may be actuated in a manner known in the art. Sliding valve 164 in second packer embodiment 126, and sliding valve 22 in third packer embodiment 200 are set in a similar, if not identical manner. Sliding valve 318 in fourth packer embodiment 300 is also set in a similar manner, but does not utilize collets, nor is alignment of sliding valve 318 with respect to ports 316 in valve housing 302 important. Sliding valve 318 is simply moved below ports 316 to open the valve. Bumper seal 314 cushions the downward movement of sliding valve 318, thereby minimizing the possibility of damage to sliding valve 318 or valve housing 302 during an opening operation.

Fifth Embodiment

Packer 412 is positioned on a tool string in a well bore and set into engagement therewith in a manner similar to the other embodiments. A setting tool is attached to upper support 490 of packer 412 and engages upper slip support 498. During setting, the setting tool pushes downwardly on upper slip support 498, thereby shearing shear pin 500. Upper slips 506 are moved downwardly with respect to upper slip wedge 518. Upper slips 506 slide along the tapered surface of slip wedge 518, and shoulders 510 on the upper slips slide along shoulder 502 on upper slip support 498. Thus, upper slips 506 are forced radially outwardly with respect to center mandrel 460.

As this outward force is applied to upper slips 506, retainer ring 508 is broken, and the upper slips are freed to move radially outwardly such that inserts 514 therein grippingly engage the well bore.

Also during the setting operation, upper slip wedge 518 is forced downwardly, shearing shear pin 520. This in turn causes packer elements 526 and 528 to be squeezed outwardly into sealing engagement with the well bore.

Substantially simultaneously, the setting tool lifts on upper support 490 and thus on center mandrel 460 which causes lower slip support 546 to be moved up and lower slips 540 to be moved upwardly with respect to lower slip wedge 536. The lower slips slide along the tapered surface of lower slip support 536, and shoulder 548 on the lower slips slide along shoulder 540 on lower slip support 546. Thus, lower slips 540 are forced radially outwardly with respect to center mandrel 460.

As this force is applied to lower slips 540, retainer ring 542 is broken, and lower slips 540 are free to move radially outwardly such that inserts 544 therein grippingly engage the well bore.

Also during the setting operation, lower slip wedge 536 is forced upwardly, shearing shear pin 538, to provide additional squeezing force on packer elements 526 and 528.

The engagement of inserts 514 in upper slips 506 and insert 544 in lower slips 540 prevent packer 412 from coming unset.

Once packer 412 is set, sliding valve 474 may be actuated. To open sliding valve 474 from the closed position shown in FIG. 6B, overshot 414 is lowered into the well bore such that collar extension 550 passes over the sliding valve. That is, bore 456 in collar extension 450 is larger than second outside diameter 477 on sliding valve 474. Inside diameter 449 of spring ring 446 is slightly smaller than second outside diameter 477 of sliding valve 474. As overshot 414 is moved downwardly, spring ring 446 engages the sliding valve and is expanded radially outwardly in gap 448 so that spring ring 446 may be moved downwardly past sliding valve 474. As this occurs, sliding valve 474 is moved downwardly such that the upper end thereof is below mandrel port 466. That is, sliding valve 474 is moved downwardly to an open position. This operation of sliding valve 474 with overshot 414 is generally simpler than the actuation of the valves in the other embodiments because positioning of the overshot is not as critical as it is with the actuating tool or stinger used for internal valves.

It will be understood by those skilled in the art that as overshot 414 is moved downwardly as described, seal ring 436 is brought into sealing engagement with first outside diameter 475 of sliding valve 474.

The opening of valve 474 as described places central opening 458 in overshot 414 into communication with central opening 464 in packer 412 through mandrel port 466. Fluid may then be flowed from any well formation below set packer 412 upwardly through the packer, overshot 414 and the tool string to which overshot 414 is connected. Once any testing or sampling is completed, raising the tool string will lift overshot 414 to close sliding valve 474. That is, lifting on overshot 414 will cause spring ring 446 to once again engage sliding valve 474 and raise it upwardly again to the closed position such that the upper end of valve 474 abuts shoulder 472 on cap 468. Further lifting will cause spring ring 446 to be deflected radially outwardly so that it can be moved above sliding valve 74 and the overshot removed from the well bore.

Sliding valve 474 may thus be opened and closed as many times as desired when packer 412 is set in the well bore.

DRILLING OUT THE PACKER APPARATUS

Drilling out any embodiment of downhole tool 10 may be carried out by using a standard drill bit at the end of tubing string 16. Cable tool drilling may also be used. With a standard "tri-cone" drill bit, the drilling operation is similar to that of the prior art except that variations in rotary speed and bit weight are not critical because the non-metallic materials are considerably softer than prior art cast iron, thus making tool 10 much easier to drill out. This greatly simplifies the drilling operation and reduces the cost and time thereof.

Fifth embodiment packer 412 has an advantage over the other embodiments in that sliding valve 474 therein is above the packer elements and slips. Thus, when packer 412 is drilled out, sliding valve 474 is drilled first, thus relieving pressure from below the valve before the slips and packer element are drilled. With the first, second, third and fourth embodiments, the upper slips and packer elements are drilled before the valve, and thus before any pressure is relieved. In some cases, this can result in the lower end of the packer being forced upwardly by the pressure once the restraint of the upper slips is removed. It is possible that this can cause jamming of the drill bit or lifting of the tool string. Fifth embodiment packer 412 avoids this problem.

In addition to standard tri-cone drill bits, and particularly if tool 10 is constructed utilizing engineering grade plastics for the mandrel as well as for slip wedges, slips, slip supports and housings, alternate types of drill bits may be used which would be impossible for tools constructed substantially of cast iron. For example, polycrystalline diamond compact (PDC) bits may be used. Drill bit 14 in FIG. 1 is illustrated as a PDC bit. Such drill bits have the advantage of having no moving parts which can jam up. Also, if the well bore itself was drilled with a PDC bit, it is not necessary to replace it with another or different type bit in order to drill out tool 10.

While specific squeeze packer configurations of the downhole tool have been described herein, it will be understood by those skilled in the art that other tools may also be constructed utilizing components selected of non-metallic materials, such as engineering grade plastics.

Additionally, components of the various packer embodiments may be interchanged. For example, thick cross-sectional center mandrel 102 may be used with valve housing 206 in second packer embodiment 200 or valve housing 302 in fourth packer embodiment 300. Similarly, thin cross-sectional center mandrel 202 could be used with valve body 144 in second packer embodiment 100. The intent of the invention is to provide devices of flexible design in which a variety of configurations may be used.

It will be seen, therefore, that the downhole tool apparatus and methods of drilling thereof of the present invention are well adapted to carry out the ends and advantages mentioned as well as those inherent therein. While presently preferred embodiments of the apparatus and various drilling methods have been discussed for the purposes of this disclosure, numerous changes in the arrangement and construction of parts and the steps of the methods may be made by those skilled in the art. In particular, the invention is not intended to be limited to squeeze packers. All such changes are encompassed within the scope and spirit of the appended claims.

What is claimed is:

1. A downhole tool apparatus for use in a wellbore, said apparatus comprising:

a center mandrel defining a mandrel central opening longitudinally therethrough and a mandrel port in communication with said mandrel central opening;

a cap attached to said mandrel and closing an upper end of said mandrel central opening;

packing means on said mandrel below said port for sealingly engaging the wellbore;

a sliding valve disposed on said mandrel and being slidable on said mandrel between open and closed positions for opening and closing said mandrel port; and means for limiting sliding movement of said valve on said mandrel, said means for limiting sliding movement being characterized at least in part by a portion of said cap.

2. The apparatus of claim 1 further comprising a means for engaging said valve such that said valve may be moved between said open and closed positions.

3. A downhole tool apparatus for use in a wellbore, said apparatus comprising:

a center mandrel defining a mandrel central opening longitudinally therethrough and a mandrel port in communication with said mandrel central opening, said mandrel being made of a non-metallic material and said mandrel central opening being molded in said mandrel;

packing means on said mandrel below said port for sealingly engaging the wellbore; and a sliding valve disposed on said mandrel and being slidable on said mandrel between open and closed positions for opening and closing said mandrel port.

4. The apparatus of claim 3 further comprising means for limiting sliding movement of said valve on said mandrel.

5. The apparatus of claim 3 further comprising a means for engaging said valve such that said valve may be moved between said open and closed positions.

6. A downhole tool apparatus for use in a wellbore, said apparatus comprising:

a center mandrel defining a mandrel central opening longitudinally therethrough and a mandrel port in communication with said mandrel central opening;

packing means on said mandrel below said port for sealingly engaging the wellbore;

a sliding valve disposed on said mandrel and being slidable on said mandrel between open and closed positions for opening and closing said mandrel port; and a means for engaging said valve such that said valve may be moved between open and closed positions, said means for engaging being characterized by an overshot defining an overshot central opening, wherein said overshot central opening is placed in communication with said mandrel port when said valve is in said open position.

7. The apparatus of claim 6 further comprising sealing means for sealing between said overshot and said valve when said valve is in said open position.

8. A downhole tool apparatus for use in a wellbore, said apparatus comprising:

a center mandrel defining a mandrel central opening longitudinally therethrough and a mandrel port in communication with said mandrel central opening;

packing means on said mandrel below said port for sealingly engaging the wellbore;

a sliding valve disposed on said mandrel and being slidable on said mandrel between open and closed positions for opening and closing said mandrel port, said valve having an enlarged diameter thereon;

means for engaging said valve such that said valve may be moved between said open and closed positions, said means for engaging being characterized by an overshot; and biasing means disposed in said overshot for resiliently engaging said enlarged diameter during opening and closing of said valve.

9. The apparatus of claim 8 wherein said biasing means is characterized by a radially outwardly expandable spring ring such that:

as said overshot is moved downwardly adjacent to said valve, said spring ring engages an upper portion of said enlarged diameter and thereby moves said valve from said closed position to said open position thereof;

as said overshot is moved further downwardly, said spring ring is expanded radially outwardly around said enlarged diameter and is passed therebelow;

as said overshot is moved upwardly adjacent to said valve, said spring ring engages a lower portion of said enlarged diameter and thereby moves said valve from said open position to said closed position thereof; and as said overshot is moved further upwardly adjacent to said valve, said spring ring is expanded radially outwardly around said enlarged diameter and is passed thereabove, thereby disengaging said overshot from said valve.

10. A downhole tool apparatus for use in a wellbore, said apparatus comprising:

a packer comprising:

a center mandrel defining a mandrel central opening longitudinally therethrough and a substantially transverse mandrel port in communication with said mandrel central opening;

packing means on said mandrel below said port for sealingly engaging a wellbore; and a valve slidably disposed on said mandrel adjacent to said mandrel port for alternately opening and closing said mandrel port; and an overshot adapted for connection to a tool string and positionable adjacent to said valve for actuation thereof between said open and closed positions, said overshot defining an overshot central opening therein which is placed in communication with said mandrel port when said valve is in said open position.

11. The apparatus of claim 10 further comprising means for limiting movement of said valve on said mandrel.

12. The apparatus of claim 11 wherein said means for limiting movement is characterized by a shoulder on a cap closing an upper end of said mandrel central opening.

13. The apparatus of claim 10 further comprising sealing means for sealing between said overshot and said valve when said valve is in said open position such that communication between said mandrel port and a well annulus is prevented.

14. The apparatus of claim 10 further comprising biasing means disposed in said overshot for engaging an outer surface of said valve during opening and closing of said valve.

15. The apparatus of claim 14 wherein said biasing means is characterized by a radially outwardly expandable spring ring.

16. A downhole tool apparatus for use in a wellbore, said apparatus comprising a center mandrel molded of a non-metallic material and defining an unmachined, molded central opening therethrough, said mandrel being positionable at a desired location in said wellbore.

17. The apparatus of claim 16 wherein said center mandrel further defines a molded mandrel port therein which is in communication with said mandrel central opening.

18. The apparatus of claim 16 wherein said mandrel is molded of an engineering grade plastic material.

19. A downhole tool apparatus comprising:

a center mandrel molded of a non-metallic material and defining an unmachined, molded central opening therethrough; and a valve slidably disposed on an outer surface of said mandrel for opening and closing said mandrel port.

20. The apparatus of claim 19 wherein said valve is made of a non-metallic material.

* * * * *